United States Patent [19]

Hornberger

[11] Patent Number: 4,564,555

[45] Date of Patent: Jan. 14, 1986

[54] COATED PART, COATING THEREFOR AND METHOD OF FORMING SAME

[75] Inventor: Dennis A. Hornberger, Reading, Pa.

[73] Assignee: Sermatech International Incorporated, Limerick, Pa.

[21] Appl. No.: 436,989

[22] Filed: Oct. 27, 1982

[51] Int. Cl.[4] ..... B32B 3/26

[52] U.S. Cl. ..... 428/312.8; 427/423; 427/427; 428/328; 428/457; 428/469

[58] Field of Search ..... 428/328, 457, 469, 312.6, 428/312.8; 427/423, 427

[56] References Cited

U.S. PATENT DOCUMENTS

| | | | |
|---|---|---|---|
| 3,248,251 | 4/1966 | Allen | 106/286 |
| 3,834,999 | 9/1974 | Hradcovsky et al. | 204/56 R |
| 4,327,155 | 4/1982 | Hanneman | 427/423 |
| 4,382,811 | 5/1983 | Lüscher et al. | 427/423 |

*Primary Examiner*—Edith Buffalow

*Attorney, Agent, or Firm*—Weiser & Stapler

[57] ABSTRACT

A coating for imparting corrosion, temperature and abrasion resistant properties to a part including at least one layer of metal particles bonded in a substantially water-insoluble material and, adhered thereto, a flame sprayed metal or metalloid oxide layer, and the article formed thereby.

55 Claims, 7 Drawing Figures

COATED PART, COATING THEREFOR AND METHOD OF FORMING SAME

This invention relates generally to erosion, corrosion and abrasion resistant coatings, coated articles, and more specifically to coatings which include a flame sprayed oxide layer. The invention also relates to parts (or substrates coated with such coatings) and a process for making same.

It is known to employ an electrolytic process to form a hard, corrosion resistant, glassy oxide film on metals, as is evidenced by the disclosures in U.S. Pat. Nos. 3,832,293 and 3,834,999 (both to Hradcovsky et al); 4,082,626 (Hradcovsky) and 4,184,926 (Kozak). These processes are commercially feasible for use in producing a film directly on metals which inherently possess electrolytic rectifiable properties, such as aluminum, magnesium, titanium and other light metals but such coatings have high permeability to gases and liquids.

U.S. Pat. No. 3,248,251 ('251 Allen) issued to Charlotte Allen relates to coating compositions consisting essentially of a slurry of solid inorganic particulate material (especially aluminum) in an aqueous acidic solution containing substantial amounts of dissolved metal chromate, di-chromate or molybdate, and phosphate. After application of a coating to the substrate, it is heated to a temperature upwards of about 500° F. until the coating is water insoluble.

U.S. Pat. No. 3,869,293 of Robert J. Brumbaugh provides a coating composition similar to the composition of the '251 Allen patent which utilizes as the solid particulate material an alloy comprising aluminum and magnesium so as to further improve the corrosion resistance of the coating.

Electrochemical methods for coating steel surfaces in an extremely short time in dichromate solution containing phosphoric acid or in chromic acid solution containing boric acid, borate or phosphoric acid are known. However, such procedures do not produce thick oxide coatings which are capable of withstanding abrasion, erosion and corrosion. U.S. Pat. No. 3,400,058 of Edward C. Ross et al notes the problem of forming a successful coating on iron and steel by electrochemical coating.

In U.S. Pat. No. 2,855,350 to Robert Ernst there is disclosed a procedure of producing an oxide coating on aluminum and aluminum alloys by electrolytic oxidation. There is noted that the presence of copper and iron ions materially affects some electrolytic baths because the appearance of the ions requires an increase in current density which results in corrosion, that is, burning of the part being oxidized.

Flame spraying is a well known technique for coating a surface with powder materials utilizing a high velocity flame and an inert gas. Flame spraying is more advantageous than vapor deposition or electro-deposition procedures for coating an article in order to produce thicker quality coatings with high deposit efficiency. However, the problem in flame spraying is that the outer layers develop stress and tension in the substrate, and sometimes the inner layers of sprayed coating materials develop stress and compression, thereby causing cracks.

When a flame sprayed coating is applied to a cylindrical object such as a shaft, the core will be in compression and the outer surface in tension. In extreme cases this stress can be sufficient to crack the coating. One technique for overcoming some of the stresses is to preheat the base material prior to application of the coating. However, where very thick coatings are applied and where no or insufficient preheating is carried out initially, the absorption of heat by the base material and a consequent expansion of it during spraying, can seriously add to the normal spraying stresses and cause hoop stresses sufficient to crack the coating.

There are additional problems when flame sprayed coatings are applied to flat surfaces since differential shrinkage will be in the direction causing the coating to lift at the edges, especially with material having high shrinkage values such as low carbon steel or 18-8 type stainless steel.

It is therefore a general object of the present invention to provide a means for flame spraying a coating on a part where no preheating is required and the problems of shrinkage are not present.

It is a further object of the present invention to provide a coating on a metal substrate which includes an oxide layer having low permeability to both gases and liquids.

It is another object of this invention to provide a coated part which withstands corrosion, erosion and abrasion for longer periods, has electrical neutrality and has excellent thermal barrier properties.

It is a further object of the present invention to apply to a substrate a coating that is strongly resistant to corrosion and erosion and will not fragment into large particles.

Another object of the invention is to improve the erosion and corrosion resistant properties of chromate/-phosphate coatings of the type disclosed in the '251 Allen patent.

A still further object of the invention is to provide an oxide layer on coated metal surfaces so as to improve their corrosion and erosion resistant properties, especially with respect to ammonium sulfate, such as from environments surrounding blast furnaces.

It is a yet still further object of the present invention to provide low carbon steel and other surfaces which are difficult to coat with a coating having low or no permeability.

In accordance with the present invention, there is provided a substrate with a coating having corrosion, erosion and abrasion resistant properties with low liquid and gas permeability wherein said coating comprises a first inner layer having metal particles dispersed and bonded in a substantially water-insoluble material, and a flame sprayed second layer deposited on said first layer comprising a substantially uniform layer of a metal oxide.

In accordance with a preferred embodiment of this invention, the first layer is formed by employing a chromate/phosphate solution in which metal particles (preferably aluminum) are dispersed therein and this solution is heat curable to a substantially water-insoluble state whereby the metal particles are bonded therein.

In the preferred embodiments of the invention, chromate/phosphate coating solution with the metal particles therein (e.g. aluminum powders) is applied to the desired surface to be protected in accordance with the method described in the '251 patent to Allen so as to form a first layer. This patent is incorporated herein by reference, especially for its disclosure of chromate/-phosphate coating compositions which are usable in this invention, as well as for its disclosure of the various methods of applying the coating to parts. Moreover, after the coating has been dried and cured to render it substantially water-insoluble, a second layer is deposited thereon utilizing a flame spraying technique.

If desired, a further protective coating may be added on the oxide layer, for example, a chromate/phosphate layer.

In the instant invention the part to be coated is provided with a first layer formed with a chromate/phosphate composition that has been heat cured to form a substantially water insoluble material with metal particles dispersed therein. Thereafter, the second layer is formed by means of a flame spraying process utilizing as a powder source those metals or metalloid elements stable for use at elevated temperatures at which the flame spraying occurs.

The flame spraying processes which may be utilized in connection with the present invention include plasma flame spraying, oxy-fuel combustion flame spraying and JET KOTE spraying or other equivalent processes. Preferable in this invention is the plasma flame spraying technique.

Plasma flame spraying is a well known technique wherein an electric arc disassociation of a diatomic or monoatomic gas takes place by ionization into a plasmic gas. This disassociation and ionizing creates the heat necessary to rapidly heat other particles into a molten mass. In the procedure the powder is injected into the plasma gas stream and propelled to a work surface using the plasma gas velocity and assisted by auxiliary airjets. Generally, the temperatures of the plasma range from 8,000° F. to 32,000° F. Plasma spraying techniques and equipment are described in *Flame Spray Handbook*, Vol. III, by H. S. Ingham and A. P. Shephard, published by Metco Inc., Westbury, N.Y. (1965), which is incorporated herein by reference.

Oxy-fuel combustion flame spraying involves a combustion process with temperatures in the range of about 5,000° F. to 7,000° F. In this process, powder is fed into the flame stream and propelled into a molten state to a work surface. Auxiliary airjets are utilized in order to increase the velocity of the gas. The fuel utilized in this procedure may be hydrogen, acetylene, cyanogen and MAPP.

The JET KOTE process utilizes high pressure propane and hydrogen fuels which achieves higher velocities and temperatures than plasma. In the JET KOTE process, powder is injected into the flame stream and propelled at high velocity to the work surface. JET KOTE is a process which is described in *The JET KOTE manual* published by Browning Engineering, Hanover, N.H. (1982) and is incorporated herein by reference.

The metal oxides which have been found to be effective for producing the coating of the invention are those compounds which are stable at elevated temperature and further may be defined as being electrically neutral. The term metal is intended to include those elements which may be defined as being metalloid, that is, elements of small atomic size which form interstitial solid solutions or interfacial compounds with metals, i.e., hydrogen, oxygen, nitrogen and carbon.

Among the oxides which may be utilized in connection with the present invention either alone or in combination include alumina, chrome oxide, silicon dioxide, titanium dioxide, zirconium oxide, and mixtures thereof.

The combination of the chromate/phosphate layer and the flame sprayed oxide layer provides a unique barrier to protect the base material from corrosion and erosion. Flame sprayed coatings are somewhat porous and therefore permeable to gases particularly in thin coatings. Undercoatings primarily referred to as a "bonding coat" are generally provided in order to strengthen the bond and to prevent erosion at the interface. The chromate/phosphate coating in the invention not only acts as a bonding coat but, in addition, is a thermal barrier so that preheating of the substrate is not required.

In addition, unlike conventional bonding coats, the chromate/phosphate layer provides a cushioning effect for the oxide layer so that there is improved abrasion resistance and reduction in fragmentation. The reduction in fragmentation is especially important for turbines which are utilized in the aerospace industry. It has been further found that the chromate/phosphate coating will not only offer a better bonding coat for flame spraying but also is considerably superior to gas penetration than the former materials used for that purpose.

Other objects and advantages of this invention will become apparent by referring to the following description, taken in conjunction with the drawings including representative coatings in accordance with the present invention.

Although the coating of this invention can be employed to impart excellent corrosion, erosion and abrasion resistant properties to parts made of various materials, it has its most beneficial use in coating parts where thermal expansion may be a problem and whose use requires a minimum amount of fragmentation of the coating or where fragments must be of small size. It is in connection with parts made of low carbon steel and stainless steel that the greatest problem or difficulty has been encountered in forming a protective coating. The present invention contributes to solving this problem. Additionally, the coatings of the present invention have been found to be especially advantageous for parts which are utilized where ammonium sulfate presents a corrosion and/or erosion problem.

It should be pointed out that in the preparation of the composition for forming the chromate/phosphate layer, the +2 and +3 valence metals are preferably used to introduce metal ions into the chromate/phosphate solution. Magnesium has been found to be outstanding for this purpose; however, zinc ion also is desirable. To achieve optimum bonding of the second or oxide layer to the first layer and optimum corrosion resistance of the entire coating, it is preferable that the metal ion concentration be at least about 1.5 moles per liter. Further, where the metal cation is all valence +2 or +3, and especially for magnesium as is preferred, it has been found desirable that the molar concentration of the metal ion not substantially exceed about one-half the total of the molar concentration of the phosphate and chromate (and/or molybdate) ions. At the same time, however, it is desirable that the metal ion concentration be at or approach this ratio of one mole per every two moles of phosphate plus chromate (and/or molybdate). For example, in the most preferred compositions where all the metal cation is +2 valence, specifically magnesium, the molar concentration of metal to phosphate to chromate is about 2 to 3 to 1.

Figure 1A:
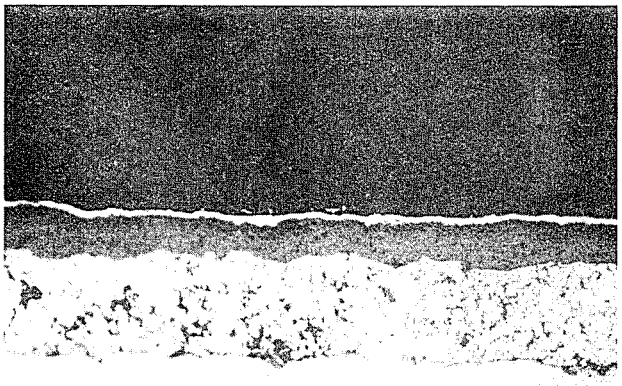
FIGS. 1A and 1B are microphotographs showing a comparison of plasma sprayed alumina and oxy-acetylene applied alumina in accordance with the invention.

In reference to the drawings, FIG. 1A is a microphotograph of a coating of the invention on a steel base which comprises a first layer of a chromate/phosphate binder which includes aluminum powder dispersed therein and an upper layer of plasma sprayed alumina.

Figure 1B:
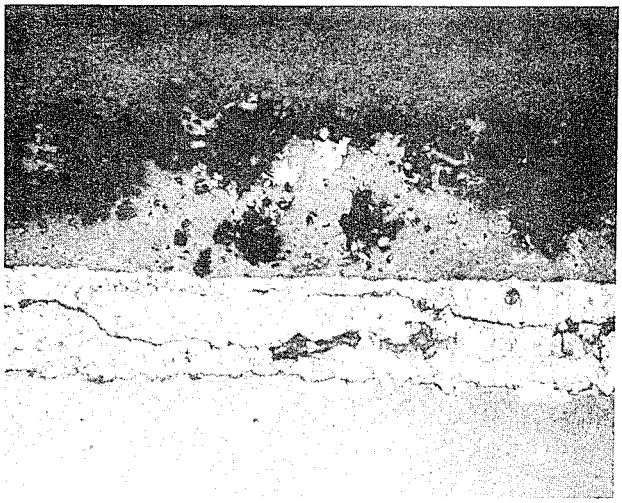

FIG. 1B shows a steel substrate with a similar chromate/phosphate layer with aluminum powder on which alumina is applied utilizing an oxy-acetylene flame process.

It has been found that the oxy-acetylene flame sprayed coating and the plasma sprayed coating are comparable in bond strength and corrosion resistance. However, the plasma sprayed coating is denser and more uniform as compared with the oxy-acetylene flame applied coating.

Figure 2A:
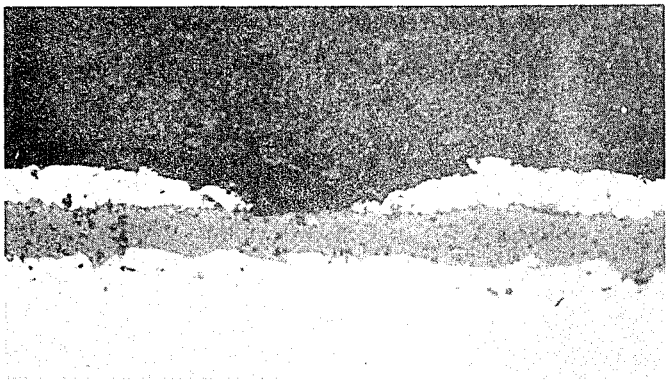
FIGS. 2A and 2B are microphotographs showing coatings of the invention with an alumina layer and various top coatings after a 168 hour corrosion test.
Figure 2B:
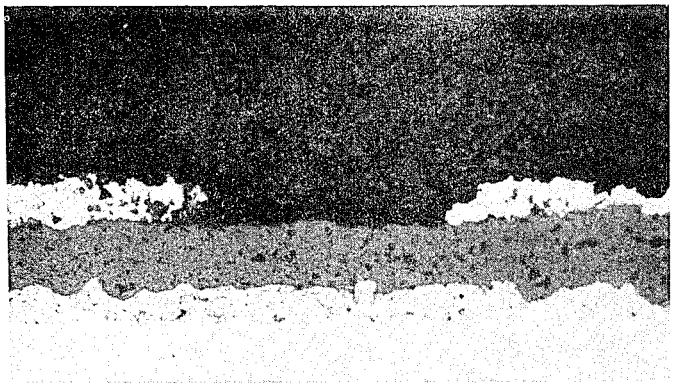

FIGS. 2A and 2B are microphotographs of coatings according to the present invention after a 168 hour corrosion test wherein alumina was plasma spray coated over a chromate/phosphate layer similar to the part in FIG. 1B wherein the top coating of a chromate/-phosphate binder (as will be hereinafter described) was applied.

Figure 3A:
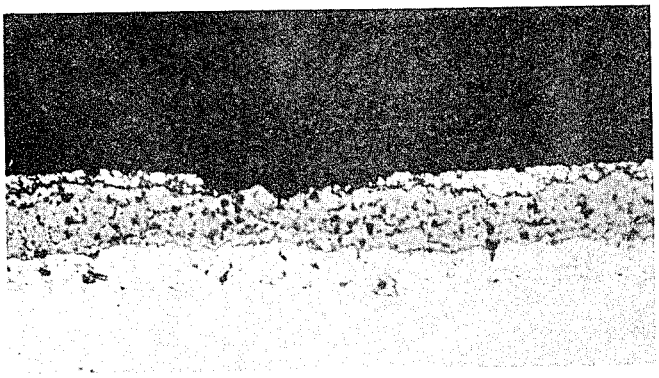
FIGS. 3A and 3B are microphotographs showing coatings of the invention with a mixed oxide layer and various top coatings after a 168 hour corrosion test.
Figure 3B:
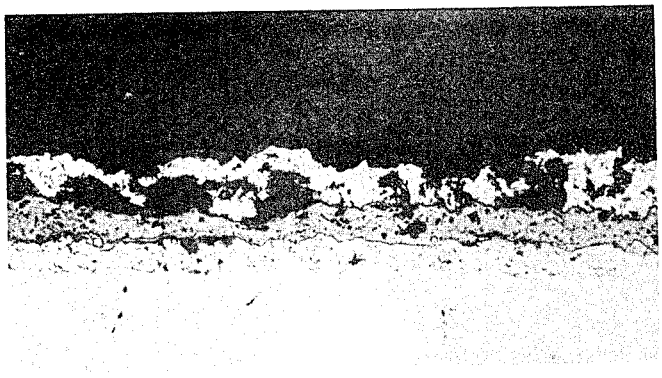

FIGS. 3A and 3B illustrate coatings of the present invention in which the oxide layer is formed by plasma flame spraying mixed oxides of chromium, titanium and silicon onto a chromate/phosphate layer similar to that of FIG. 1A on a steel substrate. In FIG. 3A, a top coating of the type utilized on a sample in FIG. 2A was used, and on the sample of FIG. 3B a chromate/phosphate layer similar to the base layer was placed on top of the mixed oxide together with a further coating of the type used on the sample in FIG. 2B. It is noted that each of the samples performed well in the ammonium sulfate test. Also, the inner layers of each of the samples are in very good condition.

Figure 4:
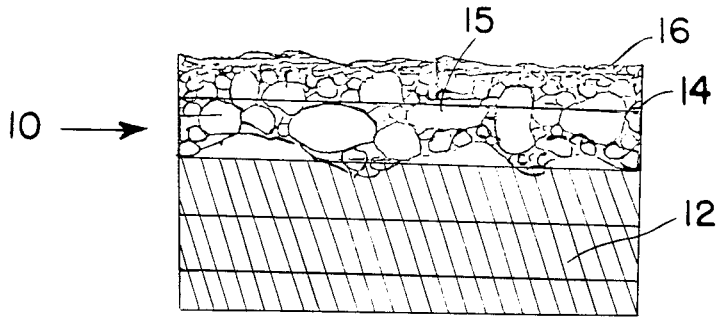
FIG. 4 is an illustration of a coating of this invention.

FIG. 4 illustrates the coatings of this invention wherein it will be noted that a coated part (10) is formed with a chromate/phosphate layer (14) adhered on a substrate (12). Metal particles (15) are dispersed throughout this first layer. On top of this first layer is the oxide layer (16) which has been applied by a flame spraying procedure.

In accordance with the preferred method of this invention, the coating is established, or formed, in a two stage operation. First, a chromate/phosphate binder, including metal particles (e.g. aluminum powder) therein, is applied to the part to be coated, such as by spraying, dipping or other suitable technique. The liquid binder in which the metal particles are dispersed is an aqueous solution of a combination of inorganic compounds from the group consisting of phosphoric acid, chromic acid, molybdic acid and the metal salt of said acids. The combination of compounds in said solution is such as will provide at least 0.1 mole per liter of dissolved phosphate (preferably 0.5 mole per liter), at least 0.2 mole per liter from the group consisting of chromate and molybdate, and optionally, at least 0.5 mole per liter of dissolved metal. Preferably, the metal particles dispersed in the binder have a grain size of less than 325 mesh, and in the most preferred embodiment of this invention are aluminum powder (spherical, 4–10 microns) present in an amount of from about 10 to 2000 grams per liter of the solution. The chromate/phosphate layer may be of any size desired; however, it has been found that a layer size of about 1 to about 1.5 mils provides suitable protection where fragmentation is a concern. The thicker the coating, the larger will be the fragments in the event of fragmentation. Most preferably, the concentration of aluminum powder is from about 600 to 800 grams per liter of solution.

It is noteworthy that, in accordance with the invention, a greater latitude is provided in the type of phosphate compositions which can be used. For instance, with respect to the above-mentioned Allen patent (U.S. Pat. No. 3,248,251) it is not necessary that the phosphate binder be confined to the various concentrations and other molar relationships disclosed by that patent. The present invention, therefore, allows for the use of a large number of and a great variety of acid binder solutions for making the coating composition in accordance with the invention.

In accordance with the invention, the first layer coating composition of the invention comprises, in addition to the acid binder which comprises phosphate ions and ions of the group of chromate or molybdate ions, metal particles dispersed therein. Most preferably the metal is aluminum and its alloys. However, any combination of metals may be utilized depending upon the requirements.

Therefore, in accordance with the invention, there is provided the liquid acid solution (which contains the phosphate ions) and the particulate metallic material, which preferably is aluminum, for use in forming a first layer on a substrate.

A preferred manner of forming the first layer of the coatings of the invention is to admix the particulate metal material under vigorous mixing conditions into the chromate/phosphate and/or molybdate-containing binder.

The sequence of addition of the components of the phosphate solutions is not critical either, as is disclosed in the prior art, for instance, the Allen U.S. Pat. No. 3,248,251.

After the chromate/phosphate coating has been applied to the part or substrate, it is heat cured to form a substantially water-insoluble material with the metal particles firmly bonded therein.

The application of the chromate/phosphate coating and heat curing may be performed one or more times depending on the thickness of the layer desired.

It is understood that other particulate materials may be added to the binder prior to mixing in amounts depending on the specific characteristics desired for the layer such as graphite, refractory metal oxides, refractory carbides, nitrides, silicides and borides, and metal carbides, nitrides, silicides and borides.

The following are representative compositions of chromate/phosphate first layer coatings usable in the invention. The invention is not limited in any way by these examples, which are provided only by way of illustration.

EXAMPLE 1

A composition for use in preparing the first layer of the coating of the invention of the type disclosed by Allen (U.S. Pat. No. 3,248,251) is prepared by mixing the following components:

| | |
|---|---|
| $MgCr_4.7H_2O$ | 266 g |
| $H_3PO_4$ | 98 g |

-continued

| | |
|---|---|
| $Mg(H_3PO_4)_2.3H_2O$ | 272 g |
| $H_2O$ to 1000 cc | |
| Aluminum powder (spherical, 5–10 mu) | 600 g |

The prepared composition may be coated on ordinary steel stock (SAE 1010 steel) by spraying, drying at 80° F. and then curing at about 625° F. for 15 minutes. However, any other suitable substrate may be used in place of the steel, i.e., nickel, chromium, copper, glass, ceramic, etc.

Similarly, there may be prepared a composition wherein magnesium chromate is replaced by any one of the following chromate-containing compounds:

| | |
|---|---|
| Chromic acid | $H_2CrO_4$ or $CrO_3$ |
| Magnesium dichromate | $MgCr_2O_7$ |
| Zinc chromate | $ZnCrO_4$ |
| Zinc dichromate | $ZnCr_2O_7$ |
| Calcium dichromate | $CaCr_2O_7$ |
| Lithium dichromate | $Li_2Cr_2O_7$ |
| Magnesium dichromate plus sodium dichromate | |

EXAMPLE 2

Following the procedure of Example 1, a binder for use in forming the first layer of the coating of the invention is prepared as follows.

| Binder | |
|---|---|
| MgO | 7.25 g |
| Chromic acid | 9.2 g |
| Phosphoric acid (85%) | 22 ml |
| Water | 80 ml |

80 g of aluminum powder (−325 mesh) is added to the binder with mixing under high shear so as to form the coating composition.

Steel parts such as tool bits, panels, turbines, screws, bolts, and fasteners are dip coated with the composition. The coatings are dried in a drying cycle at 175° F. followed by a curing step at 650° F. for 30 minutes.

If desired, in place of the aluminum, at least one of the following metals in powder form may be used:

Mg, Fe, Ti, Nb, Ca, Zr, Hf, La, Mn, Rn, V or their alloys.

EXAMPLE 3

Following the procedure of Example 1, a composition especially useful for forming the first layer of a coating of the invention on low carbon steel parts or stainless steel parts is prepared as follows:

| | |
|---|---|
| $CrO_3$ | 92 g |
| $H_3PO_4$ | 323 g |
| MgO | 72 g |
| Aluminum powder (spherical, 5–10 mu) | 800 g |
| $H_2O$ to 1000 cc | |

The ingredients are mixed, coated onto the part and cured at 700° F. for 30 minutes.

If desired, other particulate materials may be added to the composition prior to mixing, i.e., graphite (5–10 microns), refractory metal oxides, refractory carbides, nitrides, silicides and borides.

If desired, the part may be repeatedly coated with the composition and cured so as to obtain a layer of desired thickness onto which the flame sprayed oxide is then placed as will be hereinafter described.

EXAMPLE 4

Another composition was prepared following the procedure of Example 1 with the following ingredients:

| | |
|---|---|
| Chromic acid | 35.97 g |
| Magnesium oxide | 6.26 g |
| Phosphoric acid (85%) | 64 ml |
| Water to 1000 ml | |
| Aluminum powder (−325 mesh, 4–6 mu average particle size) | 600 g |

This composition is applied to phosphated steel fasteners using a "dip spin" apparatus, then cured at 525° F. for 10 minutes.

A second coating of the composition is then applied and cured likewise so that the two coatings of composition form the first layer onto which the flame sprayed oxide layer is then placed.

EXAMPLE 5

Example 4 is repeated, but magnesium/aluminum alloy (30/70) powder was added in addition to the aluminum powder.

EXAMPLE 6

A first layer for a stainless substrate steel is prepared utilizing a composition of the type disclosed by Wydra (U.S. Pat. No. 3,857,717). No cations are added, but phosphorous acid is used to react with some of the chromic acid producing trivalent chromium and phosphoric acid in situ.

| | |
|---|---|
| $H_2O$ (deionized) | 295 g |
| $H_3PO_4$ (85%) | 87 g |
| $H_3PO_3$ | 42 g |
| $CrO_3$ | 62 g |
| Aluminum powder (spherical, particle size 4–6 mu) | 400 g |

The composition may be applied to the substrate by a spray gun according to the procedure of Wydra to obtain a layer thickness of 0.1 mm. This coating is dried by heating at 50° C. for about one-half hour.

The steel substrate which can be utilized is any one of the AlSl standard alloy steel compositions, including the Mn steels, Ni steels, Ni-Cr steels, Mo steels, Cr-Mo steels, Ni-Mo steels, Cr steels and Cr-V steels.

EXAMPLE 7

A binder is prepared by mixing the following components:

| | |
|---|---|
| $MgCr_2O_7.6H_2O$ | 174 g |
| $Na_2Cr_2O_7.2H_2O$ | 75 g |
| MgO | 40 g |
| $H_3PO_4$ | 196 g |
| $H_2O$ to 1000 cc | |
| Silica (−325 mesh) | 800 g |

The prepared composition may be coated on the articles of this invention by spraying, drying at 80° F. and then curing at about 700° F. for 10 minutes.

After the chromate/phosphate layer has been applied to the part and then dried and cured into a water-insoluble state, the part preferably is subjected to a flame spraying process.

Prior to the application of the oxide layer by flame spraying, the coated part, i.e., the parts of Examples 1–7, is surface prepared by grit blasting utilizing a media in the range of 24–90 mesh. Blasting media preferably consists of clean blasting sand or alumina. The oxide layer is then applied utilizing any of the known flame spraying techniques.

The following is a typical procedure and may be usable in this invention to form the oxide layer:

PLASMA SPRAYING OXIDE LAYER

The material to be protected is prepared for the application by burning out at 650° F. for 30 minutes, followed by grit blasting with 120 grit alumina. This procedure is used to remove traces of surface oxides and carbonaceous contaminants.

A 1 to 1.5 mil coating of one of the coatings described in any one of Examples 1–6 is then applied to the clean substrate. The coating is cured at 600° F. The chromate/phosphate coating is then lightly grit blasted using 24 to 90 grit alumina. The 2 to 3 mil coating of −25 to +5 micron particle size alumina is then plasma applied to the part.

In the procedure, feed powder is fed into the plasma flame through the side of the nozzle of a plasma flame gun. The high velocity of the flame propels the powder toward a surface to be coated. Nitrogen is utilized with about 10% hydrogen, which increases the heat content of the plasma flame and acts as a deoxidizing agent.

The plasma flame spray gun may be either machine mounted or hand held, as is the case with other flame spray guns. With machine mounted guns, the machine either traverses the gun over the surface of the work at the proper rate or, alternatively, moves the work in front of the gun. Generally, for cylindrical surfaces, the gun is mounted on a lathe, using the lathe screw for traversing the gun and the lathe head for rotating the work. The plasma flame spray gun can also be provided with extension equipment for extending the head of the gun into small confined spaces as is required for spraying the inside diameter of nozzles for rocket engines.

CORROSION TEST

Coatings were tested and evaluated by subjecting them to a boiling ammonium-sulfate vapor test developed to evaluate axial compressor blade steels for corrosion resistance.

The samples were approximately 1 to 1½" square and in all cases less then ⅛" thick. All samples with the exception of two were on stainless steel, either AISI Type 403 or 410, both of which are similar to the Sulzer blade steel. The other two samples were on AISI 4340 steel. The coatings on all samples were applied to one side, with bare steel on the edges and the back side of the samples.

These samples were suspended approximately ½" above saturated ammonium sulfate solution inside a covered 2000 ml beaker. The solution was kept at a temperature of between 180° F. and 190° F. and all samples were tested for 168 hours. The solution was frequently strengthened with additions of ammonium sulfate powder to assure that saturation was maintained. All samples were observed visually and metallographically before and after the corrosion test to evaluate the coatings.

The plasma applied coatings tested for direct application on the chromate/phosphate base coat were: tungsten carbide (WC), alumina ($Al_2O_3$), and a mixed chromium-titanium-silicon-oxide (Cr-Ti-SiO-O) coating. These samples were tested in three groups using three separate one week trials.

RESULTS

The coatings containing a tungsten carbide layer performed poorly in the corrosion test (Table 1). One sample consisted of a tungsten carbide top coat applied on a coating of an Example 7 layer on an Example 2 layer, and the other two samples consisted of tungsten carbide top coat applied directly to the base coat of Example 2 composition. All three samples were severely corroded and exhibited complete delamination of the protective coatings.

The alumina protective coating on a chromate/phosphate base coat of Example 2 was the most extensively examined coating as early performed corrosion tests (ASTM 1000 hr Salt Spray Test) showed exceptional corrosion resistance. Alumina was plasma sprayed on five of the samples and was oxy-acetylene sprayed on the other sample. After metallographic evaluation of the oxy-acetylene applied alumina and the plasma sprayed alumina coatings, it was noted that the plasma sprayed coating is much denser and more uniform as compared with the oxy-acetylene applied coating (Table 2).

The alumina coating performed well in the ammonium sulfate test, and was not corroded in any of the samples. Some of the samples exhibited corrosion of the top coat layer (when it was other than $Al_2O_3$) and even some slight delamination of the base layer, but the alumina layer remained in very good condition for all of the samples tested.

The Cr-Ti-SiO-O coated samples also performed well in the ammonium sulfate test (Table 3). The Cr-Ti-SiO-O coating layer and the Example 2 base coat were not corroded in any of the three samples. A top coating was applied to the samples because the inherent roughness of the Cr-Ti-SiO-O coating was high for a compressor blade coating. The RMS (root mean square) roughness number of the Cr-Ti-SiO-O coating was 78 microinches compared to alumina which was 57 microinches.

TABLE 1

SAMPLES COATED WITH TUNGSTEN CARBIDE (WC)

| Sample No. | Base Metal | Base Coating | Middle Coating | Top Coating | Test Results |
|---|---|---|---|---|---|
| 1 | AISI Type 403 | Example 2 | None | WC | Severely corroded; WC delaminated |
| 2 | AISI Type 403 | Example 2 | Example 7 | WC | Severely corroded; WC delaminated |
| 3 | AISI Type 403 | Example 2 | None | WC | Severely corroded; |

TABLE 1-continued

| SAMPLES COATED WITH TUNGSTEN CARBIDE (WC) | | | | | |
|---|---|---|---|---|---|
| Sample No. | Base Metal | Base Coating | Middle Coating | Top Coating | Test Results |
| | | | | | WC delaminated |

TABLE 2

| PLASMA SPRAYED SAMPLES WITH ALUMINUM OXIDE COATING | | | | | | |
|---|---|---|---|---|---|---|
| Sample No. | Base Metal | Base Coating | Middle Coating | Top Coating | $Al_2O_3$ Application | Test Results |
| 1 | AISI 4340 | Example 2 | $Al_2O_3$ | — | Plasma Sprayed (FIG. 1A) | Very good condition; coating not damaged |
| 2 | AISI 4340 | Example 2 | $Al_2O_3$ | — | Oxy-acetylene Sprayed (FIG. 1B) | Good condition; no coating corrosion |
| 3 | AISI Type 410 | Example 2 | $Al_2O_3$ | — | Plasma Sprayed | Slight bubbling caused localized coating separation |
| 4 | AISI Type 410 | Example 2 | $Al_2O_3$ | — | Plasma Sprayed | Slight bubbling caused localized coating separation |
| 5 | AISI Type 410 | Example 2 | $Al_2O_3$ | Example 2* | Plasma Sprayed (FIG. 2A) | Coating corroded slightly; inner coatings excellent condition |
| 6 | AISI Type 410 | Example 2 | $Al_2O_3$ | Example 2**, 7 | Plasma Sprayed (FIG. 2B) | Outer layers severely corroded; inner layers excellent condition |

*Top coating applied as a slurry
**Coating system consisting of Example 7 top coat on Example 2 coating

TABLE 3

| SAMPLES PLASMA SPRAYED WITH Cr—Ti—SiO—OXIDE COATING | | | | | |
|---|---|---|---|---|---|
| Sample No. | Base Metal | Base Coating | Middle Coating | Top Coating | Test Results |
| 1 | AISI Type 410 | Example 2 | Cr—Ti—SiO—O | *Example 2 | Top layer severely corroded; inner layers excellent condition (FIG. 3A) |
| 2 | AISI Type 410 | Example 2 | Cr—Ti—SiO—O | **Example 2, 7 | Very good condition; top layer slightly corroded; underlayers excellent condition (FIG. 3B) |

*Top coating applied as a slurry
**Coating system consisting of Example 7 top coat on Example 2 coating Although the invention has been described with reference to the particular embodiments herein set forth, it is understood that the present disclosure has been made only by way of example and that numerous changes may be resorted to without departing from the spirit and scope of the invention. Thus, the scope of the invention should not be limited to the foregoing specification but rather only by the scope of the claims appended hereto.

While it has been found that the chromate/phosphate coatings have successfully reduced corrosion problems of parts which are subjected to a chemical environment, the coatings are susceptible to abrasive erosion. This is especially found with axial compressors used to blow air into blast furnaces where very fine particles present in the atmosphere are accelerated to great velocities within the compressor, and upon impact with the blades wear away the protective coating. This very fine erosion condition primarily affects the front two stages of blades by removing the protective coating from the blades allowing blade corrosion to occur within one year of service. The blades must be removed from service for recoating. Removal of the blades every year could result in blade damage. The present coating provides a solution to this problem.

The coatings of the invention also have excellent self-mating and anti-galling properties. The coatings are insoluble in acids, alkalis and alcohol. They are recommended for use in corrosive chemical environments in temperatures up to 350°–400° F., such as found where coke ovens are operating.

The coatings of this invention can also be used in petrochemical industry applications where a thick ceramic coating resistant to spalling during flexing, as well as having excellent wear resistance, is required. These applications include pump impellers, reciprocating pump compressor rods, centrifugal pump seals and parts. The coatings can also be used for mechanical seal applications and in the textile industry on machine elements which come into contact with fibers and threads where a fine, hard wear and corrosion resistant ceramic coating is required.

Especially advantageous use is found in the aerospace industries where parts are subjected to high temperatures, chemicals and wear. Typically, the coatings can be applied to rocket nozzles, missile nose cones, and engine parts.

These uses are noted as being merely illustrative of the application of the coatings of the invention and are not limited thereto. Other applications of the coatings and parts of the invention which may be made are within the scope of the invention.

What is claimed is:

1. A corrosion, temperature and abrasion resistant coated article comprising:

(a) a metal base surface;

(b) a first layer adhering to said base surface, said first layer comprising at least one layer of inorganic particulate material bonded in substantially water-insoluble material of a cured aqueous acidic binder comprising phosphate ions and ions selected from the group consisting of chromate and molybdate ions; and (c) a second layer on said first layer, said second layer comprising a substantially uniform porous layer of a flame sprayed metal oxide, said metal oxide being substantially electrically neutral.

2. The article of claim 1 including a protective layer on said second layer.

3. The article of claim 2 wherein said protective layer comprises a layer of metal particles bonded in substantially water insoluble material.

4. The article of claim 1 wherein said base surface is a metal selected from the group consisting of iron, nickel, chromium, cobalt and their alloys.

5. The article of claim 1 wherein said base surface is steel.

6. The article of claim 1 wherein said second layer is plasma spray deposited.

7. The article of claim 1 wherein said first layer consists of a water-insoluble material comprising a substantial amount of a phosphate and at least one compound which is a chromate, dichromate or molybdate and metal particles are dispersed therein.

8. The article of claim 1 wherein said oxide is selected from the group consisting of silicon oxide, chromium oxide, titanium dioxide and mixtures thereof.

9. The article of claim 1 wherein said water-insoluble material in which the metal particles are included is the reaction product formed by drying and curing an aqueous solution, the solute of which consists essentially of a combination of inorganic compounds from the group consisting of phosphoric acid, chromic acid, molybdic acid and the metal salt of said acids, the combination of compounds in said solution being such as will provide at least 0.5 mole per liter dissolved phosphate, and at least 0.2 mole per liter of material selected from the group consisting of chromate and molybdate.

10. The article of claim 1 wherein said metal particles are aluminum.

11. The article of claim 10 wherein the ratio of aluminum particles to other solids is from about 2 to 1 to about 5 to 1 grams per liter of the solution in which it initially is dispersed.

12. The article of claim 1 in which said particles have a grain size less than about 325 mesh.

13. The article of claim 1 in which said first layer includes particles selected from the group consisting of graphite, refractory metal oxides, refractory carbides, nitrides, silicides and borides, and metal nitrides, silicides and borides.

14. The article of claim 2 wherein said protective layer consists of water-insoluble material comprising a substantial amount of a phosphate and at least one compound which is a chromate, dichromate or molybdate.

15. The article of claim 1 wherein said second layer of flame sprayed material is added in a non-aqueous environment.

16. The article of claim 1 wherein at least two layers are provided of said substantially water-insoluble material.

17. The article of claim 1 wherein said inorganic material is non-metallic.

18. The article of claim 1 wherein said flame spraying is at a temperature of at least 5000° F.

19. The article of claim 18 wherein said temperature is in the range of 5000°–7000° F.

20. The article of claim 18 wherein said temperature is in the range of 8000°–32000° F.

21. A corrosion, temperature and abrasion resistant coating comprising: a first layer comprising at least one layer of substantially water-insoluble material having inorganic particulate material bonded therein, said water-insoluble material comprising a cured acid binder comprising phosphate ions selected from the group consisting of chromate and molybdate ions, and a second layer on said first layer, said second layer comprising a substantially uniform porous layer of a flame sprayed metal oxide, said metal oxide being substantially electrically neutral.

22. The coating of claim 21 including a protective layer on said second layer.

23. The coating of claim 22 wherein said protective layer comprises a layer of substantially water-insoluble material having metal particles bonded therein.

24. The coating of claim 21 in which said particles have a grain size less than about 325 mesh.

25. The coating of claim 21 in which said first layer includes particles selected from the group consisting of graphite, refractory metal oxides, refractory carbides, nitrides, silicides and borides, and metal nitrides, silicides and borides.

26. The coating of claim 23 wherein said oxide is selected from the group consisting of silicon oxide, chromium oxide, titanium dioxide and mixtures thereof.

27. The coating of claim 21 wherein said oxide is plasma flame deposited on said first layer.

28. The coating of claim 21 wherein said water-insoluble material in which the particles are included is the reaction product formed by drying and curing an aqueous solution, the solute of which consists essentially of a combination of inorganic compounds from the group consisting of phosphoric acid, chromic acid, molybdic acid and the metal salt of said acids, the combination of compounds in said solution being such as will provide at least 0.5 mole per liter dissolved phosphate, and at least 0.2 mole per liter of material selected from the group consisting of chromate and molybdate.

29. The coating of claim 21 wherein said particles are aluminum.

30. The coating of claim 28 wherein the ratio of aluminum particles to other solids is from about 2 to 1 to about 5 to 1 grams per liter of the solution in which it initially is dispersed.

31. The coating of claim 22 wherein said protective layer consists of water-insoluble material comprising a substantial amount of a phosphate and at least one compound which is a chromate, dichromate or molybdate.

32. The coating of claim 21 wherein said second layer of flame sprayed material is added in a non-aqueous environment.

33. The coating of claim 21 wherein at least two layers are provided of said substantially water-insoluble material.

34. The coating of claim 21 wherein said flame spraying is at a temperature of at least 5000° F.

35. The coating of claim 34 wherein said temperature is in the range of 5000°–7000° F.

36. The coating of claim 34 wherein said temperature is in the range of 8000°–32,000° F.

37. The coating of claim 21 wherein said inorganic particulate material is non-metallic.

38. A corrosion, temperature, abrasion and chemical-resistant coated article having a base surface and adhering thereon, a coating which comprises a first layer of inorganic particulate material bonded in a substantially water-insoluble material, said water-insoluble material comprising a cured aqueous acidic binder comprising phosphate ions and ions selected from the group consisting of chromate and molybdate ions, and a second layer adhering on said first layer, which second layer comprises a substantially uniform porous layer of a flame sprayed metal oxide, said metal oxide being substantially electrically neutral.

39. The article of claim 38 wherein the second layer comprises an oxide selected from the group consisting of silicon oxide, chromium oxide, titanium oxide and mixtures thereof.

40. The article of claim 38 wherein said second layer of flame sprayed material is added in a non-aqueous environment.

41. The article of claim 38 wherein said inorganic particulate material is non-metallic.

42. The article of claim 38 wherein at least two layers are provided of said substantially water-insoluble material.

43. The article of claim 38 wherein said flame spraying is at a temperature of at least 5000° F.

44. The article of claim 43 wherein said temperature is in the range of 5000°–7000° F.

45. The article of claim 43 wherein said temperature is in the range of 8000°–32,000° F.

46. The article of claim 38 including a protective top coating consisting of a water-insoluble material comprising a substantial amount of a phosphate and at least one compound which is a chromate, dichromate or molybdate.

47. A method of coating a metal or metalloid part for imparting corrosion, temperature and abrasion resistant properties thereto, said method including the steps of:

(a) applying to a surface of said part a curable liquid coating including an insoluble dispersion of metal particles therein;

(b) drying and curing said coating to thereby adhere the coating to the part and retain the particles therein; and thereafter (c) flame spray depositing a porous metal oxide onto said dried and cured coating, said oxide being substantially electrically neutral.

48. The method of claim 47 wherein step (c) is carried out to deposit $SiO_2$ onto said coating.

49. The method of claim 48 wherein said oxide is deposited by plasma flame spraying.

50. The method of claim 47 including the step of depositing a protective layer on said oxide layer.

51. The method of claim 47 wherein said part is steel.

52. The method of claim 47 wherein the surface is not preheated prior to the flame spray depositing of step (c).

53. The method of claim 47 wherein the surface is partially preheated prior to the flame spray depositing of step (c).

54. The method of claim 47 which comprises grit blasting the coated surface prior to flame spray depositing of step (c).

55. The method of claim 50 wherein the protective layer consists of a water-insoluble material comprising a substantial amount of a phosphate and at least one compound which is a chromate, dichromate or molybdate.

* * * * *